US006425503B1

(12) United States Patent
Scheindel

(10) Patent No.: US 6,425,503 B1
(45) Date of Patent: Jul. 30, 2002

(54) VALVE FOR PRESSURIZED DISPENSING CONTAINER

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 0 days.

(21) Appl. No.: 09/789,865

(22) Filed: Feb. 21, 2001

(51) Int. Cl.[7] ..... B65D 83/00
(52) U.S. Cl. ..... 222/402.22; 222/402.15
(58) Field of Search ..... 222/402.22, 402.15

(56) References Cited

U.S. PATENT DOCUMENTS

| | | | | | |
|---|---|---|---|---|---|
| 2,788,924 | A | * | 4/1957 | Soffer | 222/402.22 |
| 2,808,806 | A | | 10/1957 | Tysinger | |
| 2,849,163 | A | * | 8/1958 | Soffer et al. | 222/402.22 |
| 2,914,224 | A | | 11/1959 | Michel | |
| 2,957,610 | A | | 10/1960 | Michel | |
| 2,965,270 | A | | 12/1960 | Soffer et al. | |
| 3,926,349 | A | * | 12/1975 | Schultz | 222/402.22 |
| 4,550,865 | A | * | 11/1985 | Hirao et al. | 222/402.22 |
| 4,805,813 | A | | 2/1989 | Metcoff et al. | |
| 5,785,301 | A | | 7/1998 | Scheindel | |

* cited by examiner

*Primary Examiner*—Philippe Derakshani
(74) *Attorney, Agent, or Firm*—Reed Smith LLP

(57) ABSTRACT

A valve for a pressurized dispensing container has one or two dispensing openings through the wall of the valve stem. A dispensing nozzle with an actuating handle has a predetermined alignment with the opening or openings in the valve stem so that actuation of the nozzle will assure that one and only one full opening is presented to the product during dispensing. This keeps the leg or wall area between openings out of the path of the product being dispensed and avoids the build up of fiber that tends to clog the opening. A small retaining wall between the valve seat.at the bottom of the valve stem and the lower edge of the opening or openings provides a wall that prevents the flexible rubber-like seal from being distorted under pressure and setting in a position where it blocks the opening when product is to be dispensed. Each of the dispensing openings in the two opening embodiment extends at least 90° around the valve stem and the single opening embodiment may extend as much as 180°.

8 Claims, 5 Drawing Sheets

VALVE FOR PRESSURIZED DISPENSING CONTAINER

BACKGROUND OF THE INVENTION

This invention relates to an improved valve to be used for a pressurized container and more particularly to one that is adapted to be used in a pressurized dispensing container for a product which is highly viscous and/or contains fibers or which for any reason tends to clog in the valve through which it is dispensed.

Hand held pressurized dispensing containers having a tilt action valve assembly have been known for a long time. Applicant's U.S. Pat. No. 5,785,301 is representative of a prior art valve design for use in these pressurized dispensing containers. The sidewall at the base of the stem of the tilt valve has four openings so that when the valve is tilted, at least one opening will be exposed to the contents of the can so that the contents, under pressure from a pressurized piston container, will be dispensed through the opening in the valve stem.

It has been found that when discharging fibrous materials, the fibers tend to wrap around the wall segments or legs separating the openings thereby reducing the size of the opening and blocking flow of material.

These tilt valves, and other related type of valves, for pressurized dispensing containers have been in existence for many decades. Yet the problem of obtaining smooth and continuous flow from fiber containing materials has not been adequately resolved.

Accordingly, it is major purpose of this invention to provide a valve design for pressurized dispensing containers from which fibrous materials can be dispensed.

It is a related purpose of this invention to provide such a valve design in a fashion that will provide reliable, repeatable flow so that the flow will be similar from can to can and will be substantially consistent during dispensing from any particular can.

BRIEF DESCRIPTION

In brief, the pressurized dispensing can valve of this invention provides a single valve stem sidewall opening that is in full communication with the material to be dispensed. Such an arrangement assures that no leg between two sidewall openings is presented to the material involved. Thus the design assures there is no substrate on which fibrous material can build up to clog the openings.

For example, instead of the four openings known in the art each of which has a span of between 50° and 60°, the openings in the valve described herein are closer to 110° in circumference and there is at the most two such openings.

In order to assure that the full span of an opening is presented to the material being dispensed when the valve is tilted, a nozzle with a dispensing handle is provided. The nozzle is caused to be fully seated at a predetermined circumferential position, at which position the nozzle handle is aligned with the opening so that when the nozzle handle is actuated, the full span of a single sidewall opening is presented to and is in communication with the product to be dispensed. Thus, no leg exists to catch the fibers.

A combination of the large stem sidewall opening and the great pressure required for the product will cause the rubber like seal to flow or creep into the valve stem sidewall opening thereby reducing the effectiveness of the opening to achieve the objects of this invention. A feature which has been found to minimize this effect is to provide a small retaining wall between the lower edge of the valve stem sidewall opening and the valve seat which abuts against the lower end of the sealing grommet or rubber.

DESCRIPTION OF THE FIGURES

FIG. 1 shows the valve in the tilt, dispensing position.

FIG. 5 is a showing of the valve in a non-dispensing state.

FIG. 7 shows the single opening in position where it is in full communication with the product to be dispensed in the can to which the valve is to be attached.

DESCRIPTION OF THE PREFERRED EMBODIMENTS

Figure 1:
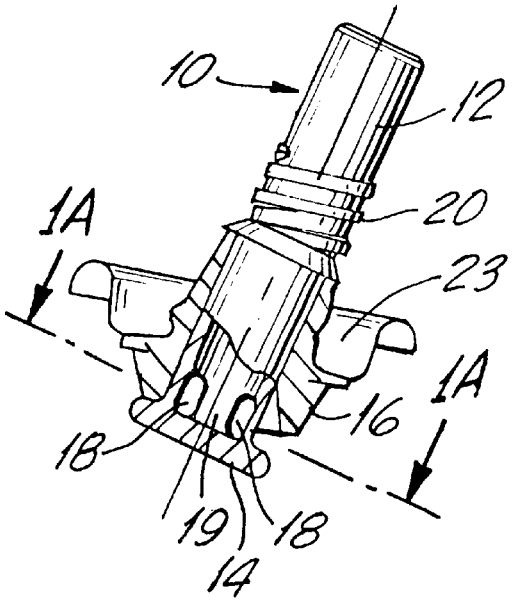
PRIOR ART FIG.1
FIG. 1 is an elevation view, in partial longitudinal section, of the prior art valve having four valve stem sidewall openings 18.
Figure 1A:
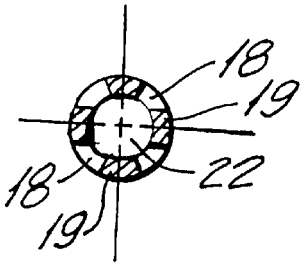
FIG. 1A is a cross-section along the plane 1A—1A in FIG. 1 showing the four valve stem sidewall openings, each having a circumferential span of about 45°.

As shown in FIG. 1, the prior art valve 10 has a stem 12, a seat 14, a resilient rubber like seal 16 and stem sidewall openings 18 separated by legs 19. Exterior threads 20 on the stem enable the addition of a dispensing nozzle to the stem. The stem 12 has a longitudinal passageway 22 therethrough which is in communication with the sidewall openings 18 so that the material in the can under pressure will be dispensed through the sidewall openings 18, the passageway 22 and whatever nozzle is attached to the stem. The cap 23 of the can is illustrated to show the manner in which the valve and its seal 16 is attached to the can.

In the known art, there are four sidewall openings 18; each having a circumferential span of approximately 45°. When the valve is tilted, two of the four openings 18, or at least a major portion of two openings 18, are exposed to the product to be dispensed. A sidewall section or leg 24 that separates the two openings 18 is in the path of the product being dispensed. Fibrous material in the product being dispensed tends to pile up and wrap around the sidewall of the leg 24 thereby building up material that partially or entirely blocks the openings 18. The result is that most fibrous materials cannot be dispensed through these valves.

One material which would be useful to dispense through these valves is a product used to seal the wall of a flat automobile tire. The product is liquid material containing mostly water and antifreeze which has a substantial amount of fibers which could be hemp or cotton Although these fibers may only be as short as 100 mils (0.1 inches), they tend to build around the legs 19. In addition, these fibers tend to create a blocking span or web across the openings 18.

Figure 3:
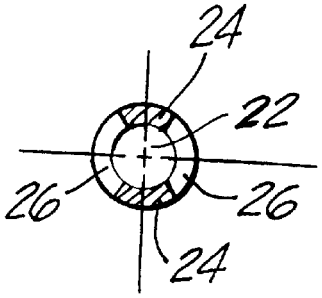
FIG. 3 is a cross-sectional view along the plane 3—3 in FIG. 2 showing the two valve stem sidewall openings, each having a circumferential span of approximately 100°.
Figure 2:
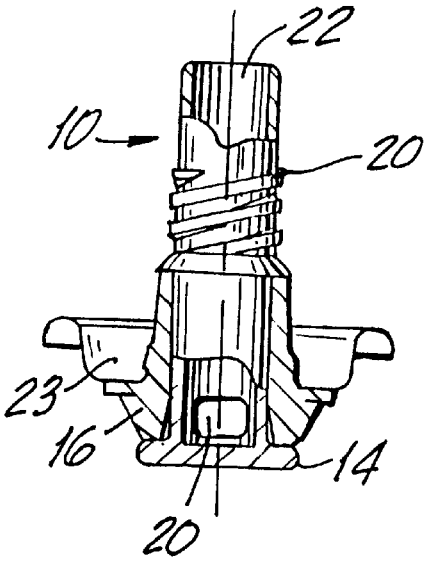
FIG. 2 is an elevation view in partial longitudinal section of a first embodiment of the valve of this invention, which embodiment has two valve stem sidewall openings 26. The FIG. 2 illustrations are in the non-dispensing state.

Applicant has found that it is possible to dispense such materials through this type of valve if the valve stem sidewall openings are created as shown in FIGS. 2 and 3. Specifically, the invention herein employs only one or two sidewall openings. The openings have a circumferential range of between approximately 80° and 180°.

Figure 4:
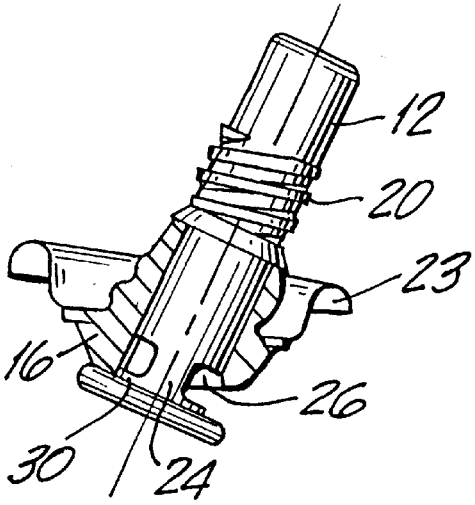
FIG. 4 is a view similar to that of FIG. 2 except that the valve is in its dispensing state. The view of FIG. 4 is 90° removed from that of FIG. 2 so that the relation of the two stem sidewall openings to the contents of the container in which the valve is to be mounted can be better visualized.

FIGS. 2 through 4 show an embodiment in which there are two stem sidewall openings 26 each of which is between 100° and 110° in circumferential span.

Figure 6:
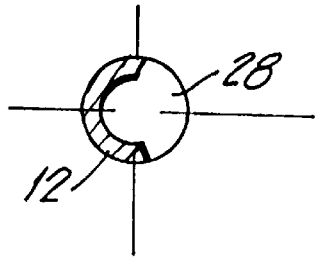
FIG. 6 is a cross-sectional view along the plane 6—6 of FIG. 5 showing the single valve stem sidewall opening having a circumferential span of approximately 125°.
Figure 5:
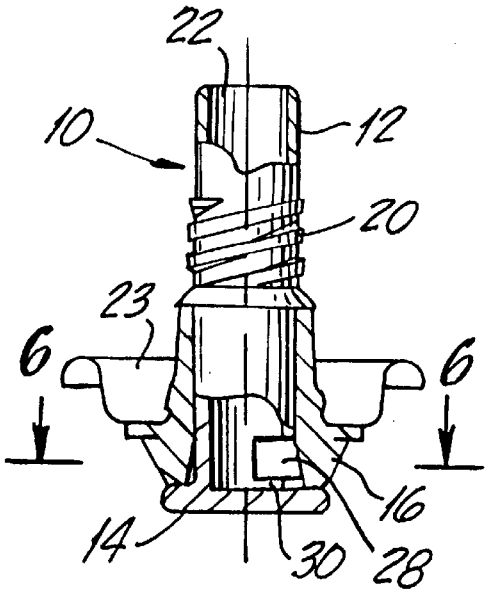
FIG. 5 is a view similar to that of FIG. 2 of a second embodiment of the valve of this invention having a single valve stem sidewall opening 28.
Figure 7:
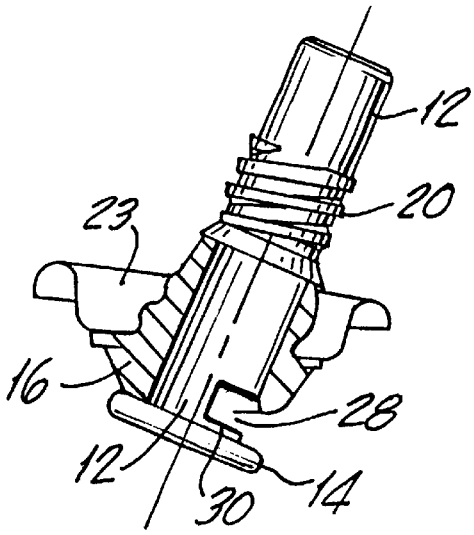
FIG. 7 is a view similar to that of FIG. 5 except that it shows the valve in its dispensing state.

FIGS. 5 through 7 show an embodiment having a single stem sidewall opening 28, which is approximately between 120° and 140° in circumferential span.

Figure 8:
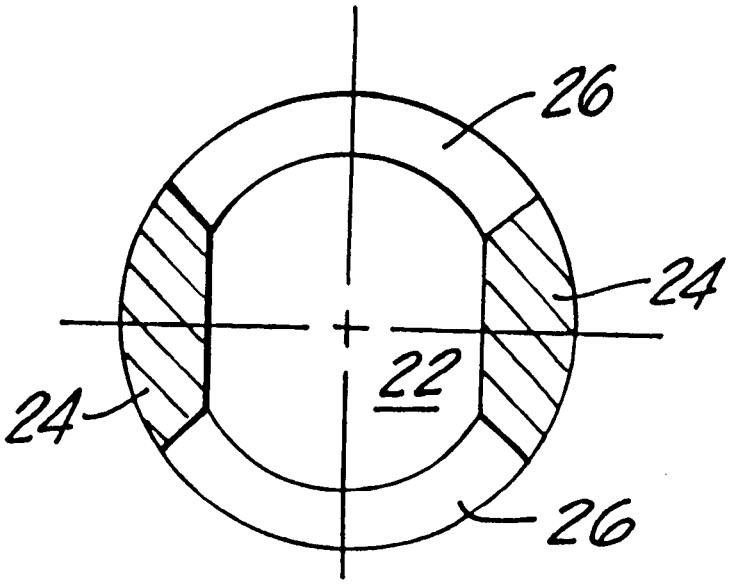
FIG. 8 is a longitudinal sectional view of the lower portion of a presently preferred embodiment of the FIG. 2 valve stem that shows the relationship between one of the two valve stem sidewall openings and a preferred sidewall design.
Figure 9:
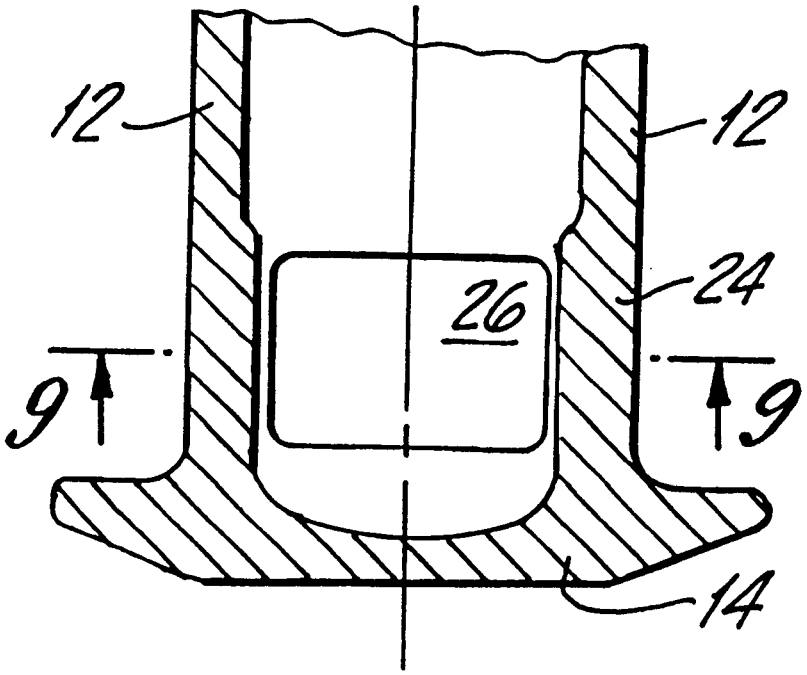
FIG. 9 is a cross-sectional view along the plane 9—9 of FIG. 8 showing the two valve stem sidewall openings and a preferred design of the associated legs 24 of the sidewall that are between the two openings.

Certain preferred details of the FIG. 2 embodiment are best shown in FIGS. 8 and 9. The legs 24 which constitute the lower portion of the stem sidewall are reinforced by being thickened so as to minimize the risk of their breaking under the large pressures that are involved in certain intended applications of this invention.

Figure 10:
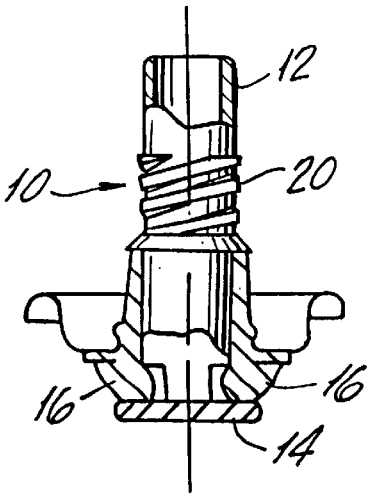
FIG. 10 illustrates the manner in which the rubber-like seal 16 tends to be pushed into the sidewall opening when the container is on the shelf, where the holding wall is missing.
Figure 12:
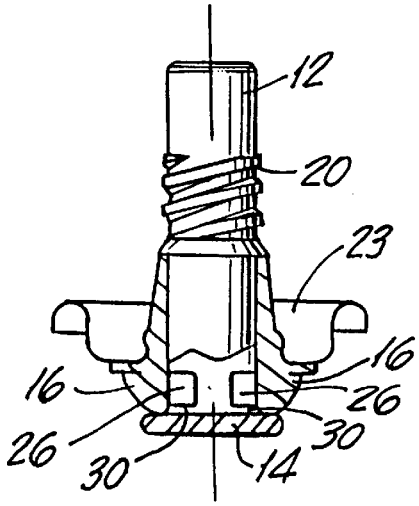
FIG. 12 is a view of the lower portion of the valve showing the holding wall 30 holding the bottom edge of the seal 16.

Furthermore, it is found quite valuable and perhaps essential, that the lower edge of the opening 26 be positioned a short distance above the upper ledge of the seat 14. In the embodiment shown, this distance is 40 mils (0.040 inches). This small distance creates a holding wall 30 that holds the lower end of the rubber seal 16 to avoid the distortion shown in FIGS. 10 and 11.

In the embodiment shown in FIGS. 2–4, the sidewall openings 26 are 225 mils wide at the inner circumference of the sidewall and 170 mils tall. The holding wall 30 is 40 mils above the ledge of the seat 14. The ledge and wall abut against the seal 16 when the valve is in the non-dispensing state.

Figure 13:
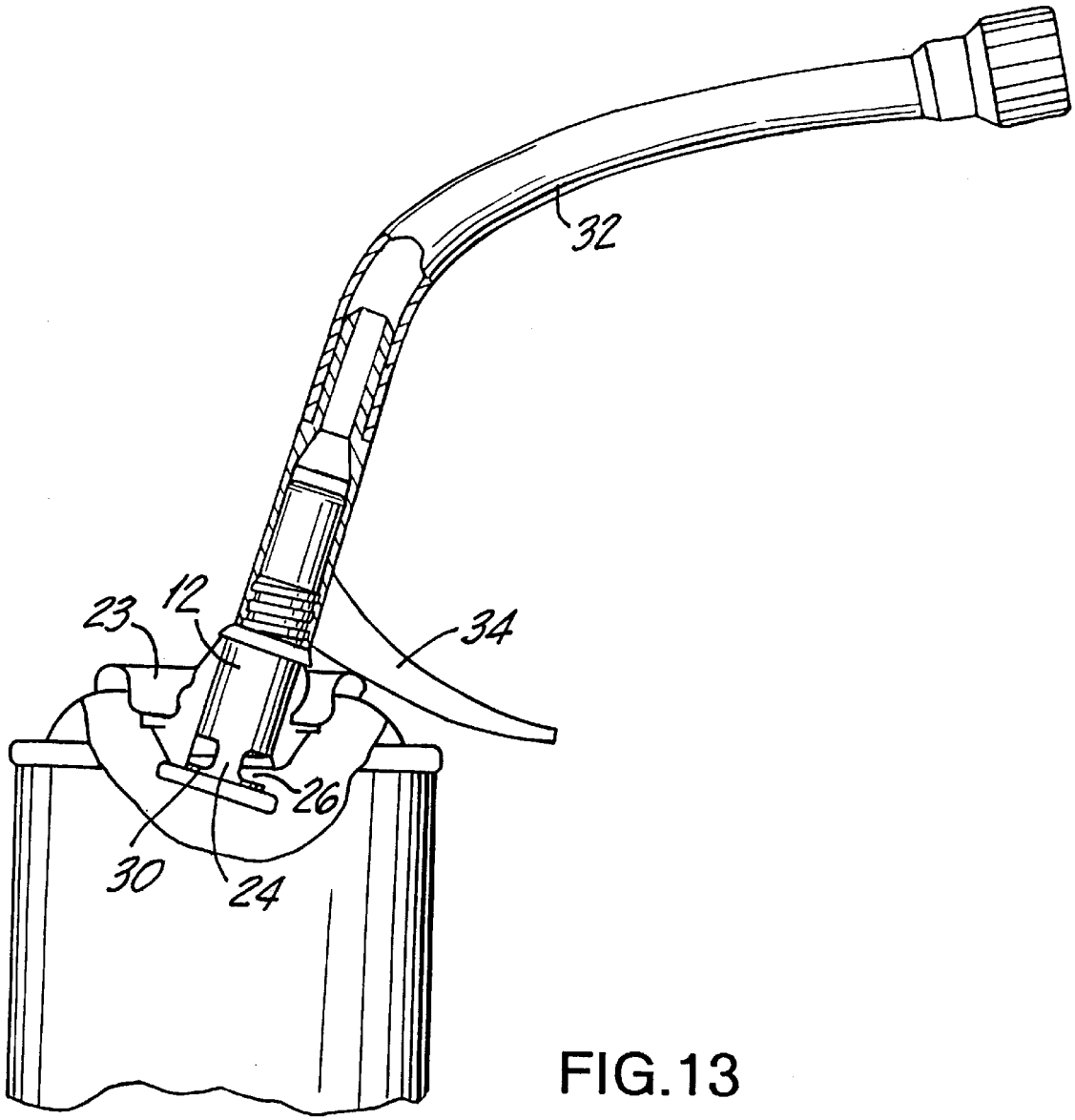
FIG. 13 illustrates a nozzle threaded on the exterior of the valve stem to assure a predetermined circumferential position of the nozzle on the stem so that the handle will be in appropriate alignment with a sidewall opening at the base of the valve stem.

FIG. 13 shows the FIG. 2 embodiment mounted on a dispensing can and in which a dispensing nozzle 32 is attached to the stem. An actuating handle or trigger 34 is attached to a rigid base portion of the nozzle 32. As shown in FIG. 13, the manually operated handle 34 has been actuated into the dispensing state in which one of the openings 26 is placed in communication with the product to be dispensed.

The screw threads 20 on the stem 12 are a double thread arrangement which permits seating the nozzle on the valve stem in about 1 ½ turns. The interior of the nozzle 32 has double screw threads which match the threads 20 and which are circumferentially placed so that when the nozzle has been screwed down on the stem, the manual handle 34 will be in a circumferential position that is in alignment with the openings 26. When the handle 34 is actuated, the full span of one of the openings 26 will be presented to the product to be dispensed and neither leg 24 will be in the path of the flow of material into the stem.

In the dual thread 20 design, the start of one thread is 180° from the start of the other thread and thus the trigger or handle 34 can be seated so that either one of the openings 26 is in communication with product.

In the FIG. 5, single opening 28, embodiment, the stem thread is a single thread because it is important that the trigger 34 be in only one possible circumferential position, in effect, overhanging the opening 28.

Figure 11:
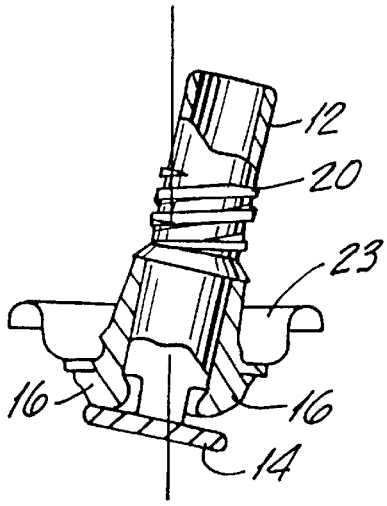
FIG. 11 shows how the seal distortion of FIG. 10 tends to set and thus block the sidewall opening in the dispensing state.

The tire sealant product in which this invention has been tested is one which has an initial pressure over 100 psi. Such a container might be on the shelf as much as a year before it is used. Under those pressures, the seal 16 of a valve that does not have a holding wall 30 would tend to set in a distorted state such as shown in FIG. 11 and thus in use, block a significant portion of the sidewall openings 26 or 28.

Although the invention has been described in connection with two embodiments, there are certain variations which can be made by one skilled in the art without departing from the scope of this invention.

For example, the orientation described of the nozzle handle to the valve stem when the nozzle is fully seated on the stem assures that the optimum communication between the sidewall openings 26 and 28 and the product being dispensed will be achieved. However, a can may be built with a visual marker or indicator to tell the user the direction in which to tilt the stem in order to achieve this result. Applicant believes this would be less fail-safe and therefore an inferior manner of embodying the invention as disclosed above.

The FIG. 2 embodiment described has been tested for use with a tire sealant product having fibers with a length of 100 mils (0.1 inches). Applicant believes that this invention will also prove useful for dispensing of very viscous products such as a ten million centipose urethane. Because of the tendency of highly viscous products to bridge an opening, the employment of a single wide opening having no leg to split the path of flow through the opening would make it possible to obtain ready flow of material having a large viscosity which otherwise is likely to bridge across two separate openings on either side of the leg.

This invention can be applied to a valve arrangement in which the stem is caused to move axially or longitudinally down into the product without tilting. This has the advantage of exposing both of the FIG. 2 openings 26 and assuring an effective dispensing of material.

What is claimed is:

1. A valve for use in dispensing a fiber containing composition from a pressurized dispensing container, comprising:

said valve having a seat extending radially outward from the bottom of the valve stem, and a flexible seal engaging the seat when the valve is in a non-dispensing state to seal said dispensing openings from the composition in the container with which the valve is used, a valve stem with a wall defining a main passageway, at least one and no more than two dispensing openings through said wall of said valve stem, a dispensing actuator coupled to said valve stem and positioned to actuate said valve into a dispensing state so that one and only one of said openings is in communication with the material to be dispensed from the container with which the valve is used and so that the full span of said only one opening is in said communication.

2. The valve of claim 1 further comprising:

a retaining wall for the seal when the valve is in a non-dispensing state, said retaining wall defined by each of said openings having a bottom edge positioned at a predetermined short distance above said seat.

3. The valve of claim 2 wherein said retaining wall is approximately 40 mils tall.

4. The valve of claim 1 wherein said at least one opening is two openings substantially equally circumferentially spaced.

5. The valve of claim 4 at wherein each of said openings is approximately between 90° and 110°.

6. The valve of claim 1 having a single dispensing opening extending around said valve stem.

7. The valve of claim 6 wherein said single dispensing opening extends approximately between 110° and 180° around said wall of said valve stem.

8. The valve of claim 1 wherein said dispensing actuator comprises:

a nozzle having an actuating handle, said nozzle engaging said valve stem in a fashion that predetermines the circumferential position of said handle relevant to said valve stem, said predetermined position being in circumferential alignment with said openings of said valve stem, whereby actuation of said valve by said handle causes said full span of one of said openings to be in communication with the composition to be dispensed.

* * * * *